United States Patent [19]

Bossert

[11] 4,161,891

[45] Jul. 24, 1979

[54] OPERATING HANDLE ATTACHMENT ARRANGEMENT, PARTICULARLY WINDOW CRANK FOR AUTOMOTIVE VEHICLES

[75] Inventor: Walter Bossert, Geislingen-Weiler, Fed. Rep. of Germany

[73] Assignee: Bossert AG, Geislingen, Fed. Rep. of Germany

[21] Appl. No.: 789,474

[22] Filed: Apr. 21, 1977

[30] Foreign Application Priority Data

Apr. 23, 1976 [DE] Fed. Rep. of Germany ..... 2617691

[51] Int. Cl.[2] ..... G05G 1/00

[52] U.S. Cl. ..... 74/548; 292/348; 16/114 R; 403/357; 74/543

[58] Field of Search ..... 74/545, 543, 558.5, 74/557; 292/348, 349, 355; 16/110 R, 114 R, DIG. 19, DIG. 24, DIG. 25; 403/330, 321, 316, 357

[56] References Cited

U.S. PATENT DOCUMENTS 2,657,083 10/1953 Krohm ..... 403/357
3,222,951 12/1965 Maursey ..... 74/543

FOREIGN PATENT DOCUMENTS 2123613 5/1971 Fed. Rep. of Germany ..... 292/348
7303425 7/1973 Fed. Rep. of Germany .
2008171 1/1970 France ..... 292/349

*Primary Examiner*—Samuel Scott
*Assistant Examiner*—G. A. Anderson
*Attorney, Agent, or Firm*—Frishauf, Holtz, Goodman & Woodward

[57] ABSTRACT

To secure an operating handle or crank to an operating shaft while inhibiting undesired axial removal of the handle from the shaft, yet permitting controlled removal, for example for repair, a coupling element made of a yielding plastic material, for example of a polyamide resin, is slipped on the shaft, the shaft and the coupling element being formed with interengaging projections and recesses, for example a groove in the shaft and inwardly projecting shoulders on the coupling element. The coupling element itself is slit radially, so that it can be expanded and removed from the shaft by release of the interengaging projections and recesses. The operating handle is formed with recesses to receive axially projecting extensions of the coupling element which engage in the recesses to lock the handle to the coupling element and thus prevent axial removal. Rotation is transmitted between the handle and the shaft by direct engagement of splines and flutes formed on the shaft and the handle, respectively.

45 Claims, 15 Drawing Figures

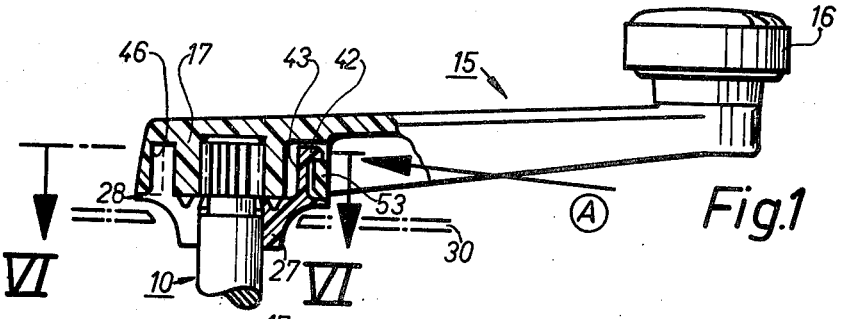
Fig.1
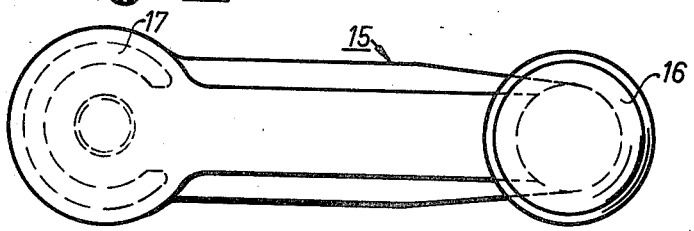
Fig.2
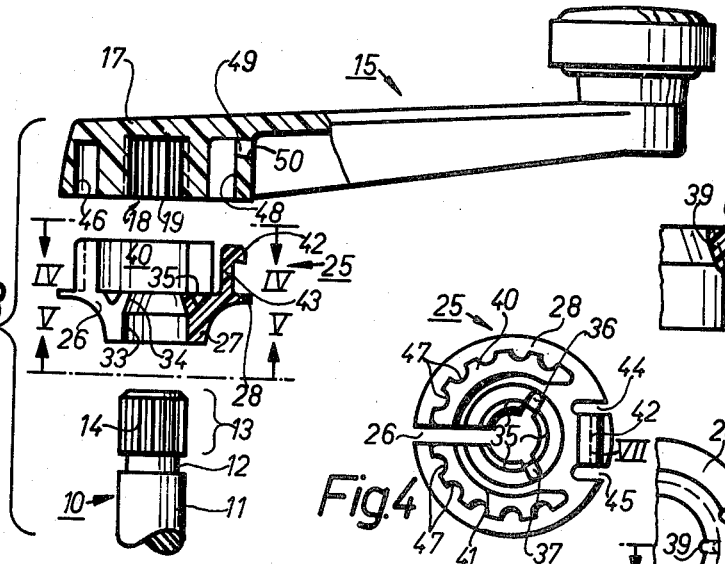
Fig.3
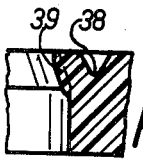
Fig.7
Fig.4
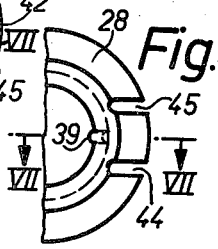
Fig.5
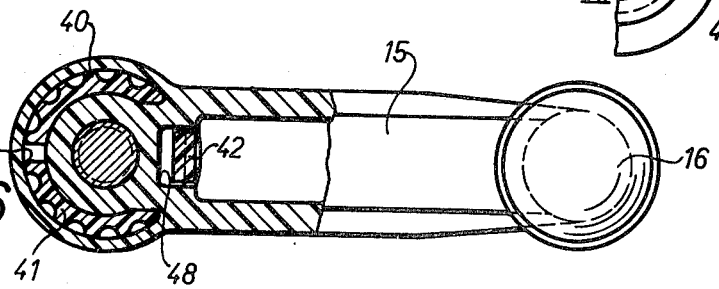
Fig.6

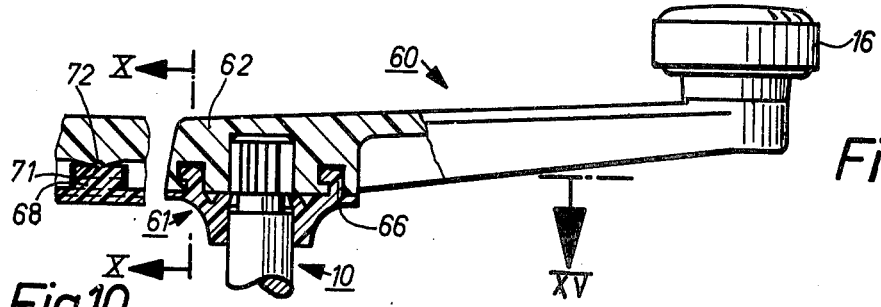
Fig.9
Fig.10
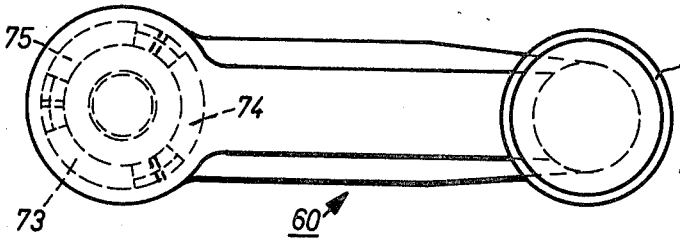
Fig.11
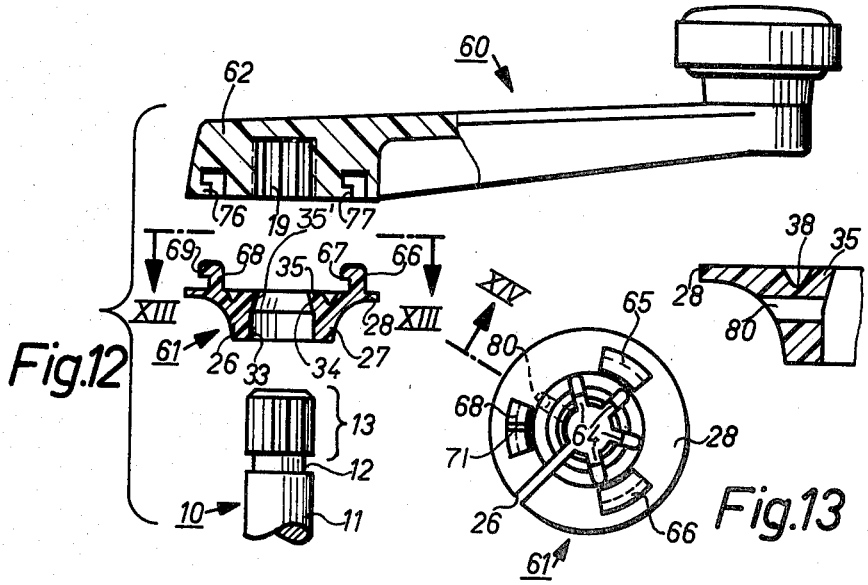
Fig.12
Fig.13
Fig.14
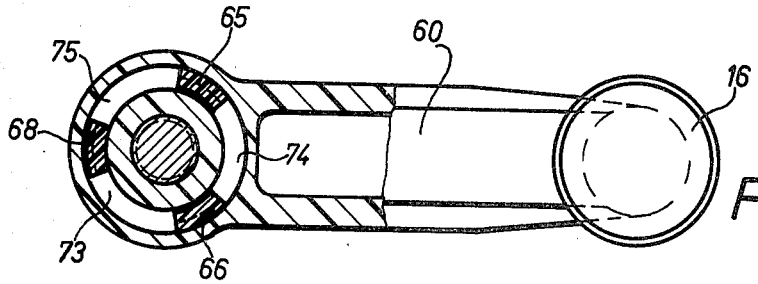
Fig.15

OPERATING HANDLE ATTACHMENT ARRANGEMENT, PARTICULARLY WINDOW CRANK FOR AUTOMOTIVE VEHICLES

The present invention relates to an attachment arrangement to secure an operating handle, typically the crank for the window of an automotive vehicle with an operating shaft, such as the window crankshaft, in such a manner that the operating handle transmits rotary movement to the shaft while being axially secured thereto and releasable only when desired, for example for repair or maintenance of the mechanism connected to the shaft.

Various types of operating handles and cranks have been proposed; one such prior structure is shown in German Utility Model DT-GM 7,303,425, assigned to the assignee of the present application. This publications shows a window crank made of plastic which, by means of a special type of internal flutes, is secured to a stub shaft likewise formed with matching ridges and flutes. The crank is secured against axial removal by means of a wire clip, bent in re-entrant shape, and slipped through suitable slits formed in the hub of the crank to engage a groove in the stub shaft. It has also been proposed to secure cranks to shaft against axial removal by means of set screws or the like, or by screws which axially engage the outer end of the stub shaft. Both types of attachment arrangements are used in millions of automotive vehicles; they require a comparatively complex construction and assembly; in mass-produced articles of this type, differences in price in the order of fractions of cents form substantial factors in the final price the product.

It is an object of the present invention to simplify known arrangements coupling operating handles and cranks to shafts and particularly to stub shafts to operate windows in automotive vehicles. The arrangement should permit manufacture of the cranks of plastic material and permit rapid and reliable attachment to metal shafts, securely holding the crank to the shaft and inhibiting undesired removal while permitting ready release of the crank from the shaft for maintenance or repair of the attached mechanism, for example the window or the door of an automotive vehicle.

Subject matter of the present invention: Briefly, a coupling element, made for example of a yielding plastic material such as a polyamide is interposed between the shaft and the hub of the operating handle or crank. The coupling element is locked to the shaft by interengaging projection and recess means, for example in the form of a groove on the shaft engaging snap-in shoulders on the coupling element to prevent axial removal of the coupling element from the shaft. The hub of the crank, or operating handle, is then slipped over the end of the shaft, the hub and the shaft being formed with engaging flutes, splines, or other engaging non-circular surfaces to provide rotation from the handle to the shaft. Axial removal of the crank or operating handle from the shaft is prevented by locking elements located both on the hub of the operating handle and on the coupling element, for example in the form of snap-in fingers on the coupling element which engage in suitable recesses in the handle. The locking elements can be externally accessible, for example by pushing a pin against the snap-in fingers to permit axial removal of the operating handle from the shaft, and subsequent removal of the coupling element from the shaft if it is desired to have access to the portions of the shaft beneath the coupling element.

The arrangement is simple to secure on a stub shaft. After releasing the operating handle from the coupling element, the coupling element itself can readily be removed from the stub shaft itself. Preferably, it is slit radially, so that upon insertion of a simple tool, for example a screw driver, into the slit, the portion of the coupling element surrounding the shaft can be expanded so that it can be removed, axially, from the shaft. Assembly and disassembly thus are simple and can be carried out in work-saving and obvious steps. The arrangement additionally permits comparatively long axial engagement between the operating handle or, rather, its hub and the stub shaft than in known constructions. This is important if the stub shaft is made of metal, or substantial torques are to be transmitted between the operating handle and the stub shaft. Particularly, if the operating handle is made of plastic, the surface forces being transmitted should not become too high.

Drawings, illustrating an example:

FIG. 1 is a side view, partly in section, of the window crank for an automobile window, secured to a window operating shaft;

FIG. 2 is a top view of the window operating crank;

FIG. 3 is an exploded view of the attachment arrangement of FIG. 1 illustrating, in separate detail and partly in section, the crank, the coupling element, and the end portion of the window operating shaft;

FIG. 4 is a top view of the coupling element and taken line IV—IV in FIG. 3;

FIG. 5 is a fragmentary bottom view taken in the direction of line V—V of FIG. 3;

FIG. 6 is a cross section taken along line VI—VI of FIG. 1;

FIG. 7 is a cross section taken along line VII—VII of FIG. 5 and showing a detail;

FIG. 9 is a view similar to FIG. 1 and illustrating another embodiment;

FIG. 10 is a fragmentary sectional view taken along line X—X of FIG. 9 and illustrating engagement of the coupling element to the crank;

FIG. 11 is a top view of the crank of FIG. 9;

FIG. 12 is an exploded view of the arrangement of FIG. 9, partly in section;

FIG. 13 is a top view of the coupling element and taken line XIII—XIII in FIG. 12;

FIG. 14 is a sectional view of a portion of the coupling element shown in FIG. 13 and taken along line XIV—XIV of FIG. 13; and FIG. 15 is a partly sectional top view taken along line XV—XV of FIG. 9.

Figure 8:
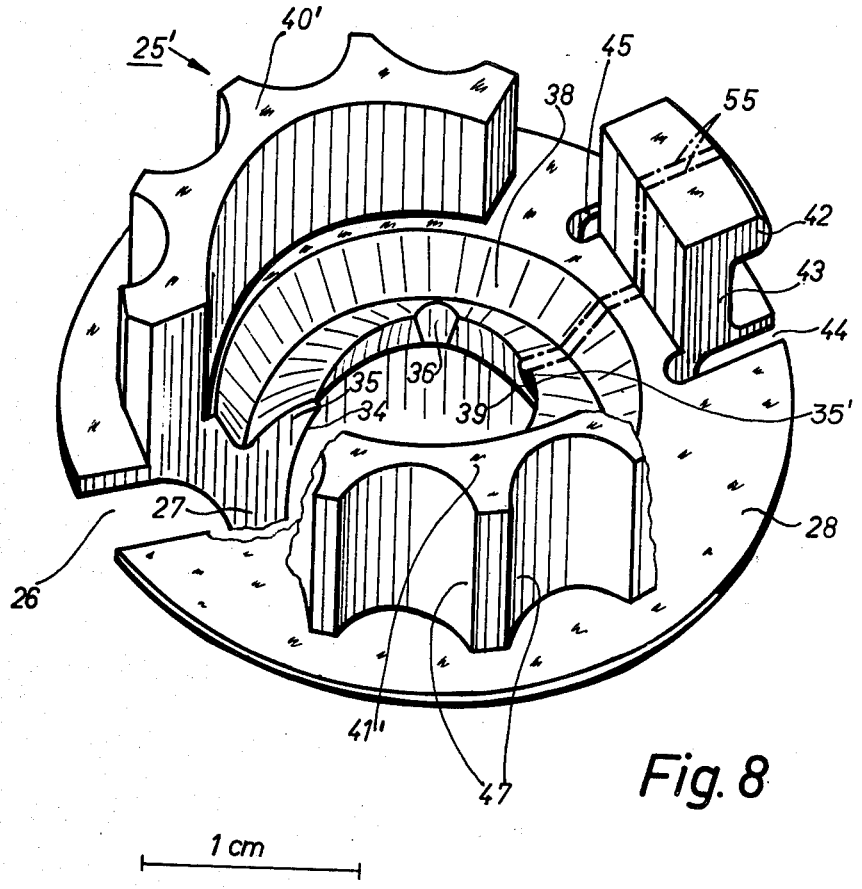
FIG. 8 is a perspective view of a coupling element which is slightly different from the one shown in FIG. 1, with a scale mark to a show a representative size.

A stub shaft 10 (FIGS. 1, 3), for example the operating shaft of a passenger car window operating mechanism, projects from a wall 30, shown only in fragmentary chain-dotted representation and forming, for example, the inner door panel of a passenger automobile. Shaft 10 has a cylindrical portion 11 (FIG. 3), an inset groove 12, and an operating portion 13 which is formed with axial gear-like projections, or flutes and splines. The window operator is formed as a crank 15 which is of conventional appearance. In cross section, it is generally U-shaped and includes an arm made, for example, of fiber-reinforced plastic, for example a polyamide, reinforced with glass fibers, the free end of which has an operating knob 16 rotatably secured thereto. The hub 17, unitary with the crank 15, is formed with an inner recess 18 having internal gearing 19 which is complementary to the axial outer gearing or fluting 14 on the shaft 10.

The crank 15, if merely stuck on shaft 10, could be axially removed therefrom unless additional means were provided to axially secure the crank 15 against removal. The gearing 14 may, for example, have a length of about 11 mm; this length is substantially longer than the usual or customary length of about 6 mm, and thereby permits better engagement of crank to the shaft and hence increased transfer of torque.

In accordance with the present invention, a coupling element 25 is provided to axially secure crank 15 to the shaft 10. This element 25 is a plastic injection molding made, for example, of a polyamide plastic or, for example, of the plastic known under the trademark DELRIN. The shape of the coupling element is best seen in FIG. 8. The element 25' of FIG. 8 differs slightly from element 25 of FIGS. 1 to 7. The differences will be explained below; the general structure, operation and appearance of element 25' of FIG. 8 corresponds, however, generally to element 25 of FIGS. 1–7.

The coupling element 25, or 25', respectively, is a unitary injection-molded part made of polyamide plastic and is shaped to be an elastically expandable ring-like structure which can be clamped around shaft 10. In the side remote from the crank handle button 16, the coupling element 25 is formed with a longitudinally, radially and axially extending slit 26. Slit 26 is provided to permit engagement with a tool, for example with a screwdriver, to expand the entire coupling element 25 radially and, by spreading it apart, permit withdrawal, or insertion of element 25, or 25', respectively, over the fluted portion 14 of shaft 10. The notch or cut 26 is best seen in FIGS. 4 and 8. The coupling element 25 extends into a projecting portion 27 of decreasing diameter in the direction towards the operating end 11 of shaft 10—that is, downwardly with respect to FIG. 3. When assembled to the shaft, the coupling element snugly surrounds the cylindrical shaft portion 11. Preferably, the diameters of the axial bore formed in the coupling element and of the shaft 10 are so selected that the coupling element surrounds the shaft 10 without play (see FIG. 1). Starting from this projection 27, the coupling element 25 becomes wider towards the upper side and terminates in a washer-like rim 28, the outer diameter of which corresponds to the outer diameter of the hub 17 of crank 15. When assembled together, the rim 28 fits directly, preferably snugly, against the underside of hub 17 (FIG. 1). When assembled to a door, the rim 28 with its underside engages the door panel shown by chain-dotted lines 30 and thus prevents penetration of dirt or other contamination into the interior of the door, and hence towards the door and window operating mechanism.

The inner surface of the projection 27 forms a cylindrical portion 33 which terminates in a conical portion 34, bent somewhat inwardly, to engage groove 12 of shaft 10. The conical portion 34 defines the inner surfaces of a resilient, elastic abutment element 35 which extends radially inwardly—with respect to the longitudinal axis of the coupling element 25. Its upper surface extends approximately perpendicularly to the longitudinal axis. The angle of inward bend is preferably about 20° with respect to the longitudinal axis, but this is not a critical angle and may well range from between about 15° to 40°. The difference between the embodiment of FIGS. 3 and 8 will here be noted, in that the inwardly projecting portion 34 in FIG. 8 has a pointed end 35' rather than the flat surface of element 35, as best seen in FIG. 3. The element 35 is subdivided into several circumferential sections, for example, as shown, into three sections extending about 110° circumferentially. One such section extends from the slit 26 to a break line 36; the second section from break line 36 to a subsequent break line 37; and the third from break line 37 to slit 26. A deep, neatly rounded ring groove 38 (FIG. 7) surrounds the elements 35, or 35', respectively. The subdivision of the elements 35, 35' into sections by means of the breaks 36, 37 and the axial slit 26 decreases the spring constant of the abutment elements 35, 35'. This is important since, upon assembly, the coupling element 25, 25' must be slipped over the fluted or toothed section 14 of the shaft 10. The elements 35, 35' must be capable of resiliently expanding outwardly. The force required to effect such change, that is, to permit the resilient outward expansion, should preferably be low so that assembly can be carried out without tools, for example by manual pressure on the coupling element 25, 25', respectively, or by a blow, for example with the fist, against the coupling element. The coupling element located between the break lines 36, 37 is formed with an inwardly extending bulge 39 (FIG. 7) which is used as a locating projection. It is located in exact axial alignment with a tooth of the inner teeth 19 of the crank so that, when the locating projection 39 engages a flute in the fluted section 14 of shaft 10, precise alignment of the fluting of the crank with respect to the fluting 14 on the shaft is ensured. By accurately angularly aligning, and maintaining the angular alignment of the coupling element and the handle, damage to the fluting in the handle and/or on the shaft 14 can be easily avoided and positive engagement in predetermined position of the crank, with respect to the coupling element, can be easily ensured.

The rim 28 (FIGS. 1, 4) is formed with two axial projections which, preferably, are symmetrical with respect to each other. These projections form circular segments 40, 41 (FIGS. 3, 4, 6) which fit into complementary recesses 46 of hub 17 of crank 15. The projections 40, 41 fit snugly, and without play, into the recess 46 of the hub 17, forming a cylindrical fit. The portions 40, 41 are fluted, as seen at 47, in order to save material and to permit easy assembly and disassembly. The flutes 47 are preferably axially parallel. Five flutes 47 are shown in the portions 40, 41 of element 25 of FIGS. 1–7; only four flutes for each portion are shown in the projections 40', 41' of the coupling element 25' of FIG. 8. This is an engineering modification, and the number, size and depth of the flutes is determined essentially by consideration of strength and forces applied to the sections 40, 41 or 40', 41', respectively. The segments 40, 41 and 40', 41' extend over an angle of between 60° to 150°; this angle is not critical and various modifications, and within wide ranges, are possible. More or less than two segments may be used, or equivalent locating elements, such as pins or the like; the arrangement can also be reversed and the segments can be placed on the hub 17, with a solid cylindrical portion extending from rim 28 formed with a recess to receive the segments extending from hub 17.

The coupling element 25, when pushed on shaft 10, will engage reliably with the shaft and will be secured against axial removal by engagement of the segments 35 in groove 12. To permit releasable engagement between the hub 17 of crank 15 and the coupling element 25, an externally accessible engagement hook 42 is provided, preferably molded-on and integral with the element 25, as best seen in FIG. 8 with respect to element 25'. Hook 42 is located at the upper end of a springy or resilient element 43 (compare FIGS. 3 and 8) to engage crank 35. To reduce the spring constant of element 43, a groove 44, 45, respectively, is formed in the rim 28. Grooves 44, 45 extend parallel to a radial line through the center of the rim 28. The grooves or notches 44, 45 have the practical effect of extending the length of the springy portion of the element 43 and thus to reduce its spring constant.

The hub 17 of crank 15 is formed with an axial recess 48 terminating in a radially extending recess, preferably an open window 49. Window 49 receives the hook 42 of element 43. The upper surface of the hook 42 is preferably slightly chamfered or tapered.

Operation and assembly: The coupling element 25 or 25' is attached to the shaft 10 by axial pressure, or a quick blow, causing the portions 35 or 35' to engage in the groove 12 formed in shaft 11. To then assemble the crank, the hub 17 is slid over the fluted portion 14. In this movement, the springy portion 43 of the hook is inwardly deflected and then snaps radially outwardly into window 49, so that the hook 43 will snap into the opening. The surface of the window 49 which defines the lower edge thereof, seen at 50 in FIG. 3, is preferably downwardly inclined to provide for secure, non-releasable engagement. The lower edge of the hook 42 also is downwardly inclined; a suitable and preferred angle is about 10°, although this is not critical. As best seen in FIG. 1, hook 43 will then be securely held by the portion 53 of the hub 17, so that the axial attachment of the handle 15 is practically without play.

Disassembly: To release the crank 15, for example for maintenance or repair of the window or lock unit behind wall 30, a suitable tool, for example a screwdriver, is passed through window 49 to snap hook 43 radially inwardly, in the direction of the arrow A (FIG. 1). The crank 15 can then be axially removed. To additionally remove the coupling element, the screwdriver is inserted in slot 26 (FIG. 4) of the coupling element and it, likewise, can be easily removed from the shaft end. No specific disassembly instructions need be provided since the disassembly steps are obvious to any mechanic looking at the structure.

For mass production assembly, the window crank 15 can be pre-assembled with the coupling unit 25. The window crank, made separately, and the coupling unit are pre-assembled by the manufacturer thereof. For assembly, it is then only necessary to place the coupling element in the desired angular position—as determined by the manufacturer of the vehicle —so that the position of the crank 15 on shaft 10 will be in accordance with design, and slight rotation of the subassembly permits engagement of the locating projections 39 (FIG. 7) in the next adjacent suitable groove of the axial fluted portion 14. The crank, with the coupling element therein, can then be pressed on the stub shaft 10; the engagement elements 35 can deflect radially outwardly, without interference from the already pre-assembled crank, to slide over the outer surfaces of fluted portion 14 of shaft 10, to then engage into ring groove 12. The crank is securely held on the stub shaft 10 and, upon rotation thereof, will carry shaft 10 along.

To disassemble, for example for maintenance or repair, a screwdriver is engaged in direction of the arrow A (FIG. 1) to deflect the hook 42 inwardly and release the locking of the crank to the coupling element. The crank can then be removed from the coupling element 25, 25'. Upon removal of the crank 15, the coupling element 25 is easily accessible and can be spread apart by engagement, for example of the screwdriver, in slot 26 so that the coupling element can be slipped upwardly (FIGS. 1, 3). This, then, exposes the entire opening of the door panel 30 which can then be removed from the shaft. The crank 15 can be re-used; the coupling element likewise is re-usable, and can be assembled separately, or pre-assembled with the crank. There is practically no wear on the coupling element or on the crank during assembly or removal.

The coupling element can be constructed as a single unitary molding, or can be constructed in two parts. For example, and referring to FIG. 8, the coupling element can be made in two portions, separated along the chain-dotted line 55 (FIG. 8). This severance line is preferably placed centrally through the engagement hook 42. The result will be two adjacent engagement hooks which can be conjointly released by pressure of a screwdriver blade against the outer edge of the hook portion 42. The elasticity of the hub 17 contributes essentially to engagement of the portions 35, 35' respectively in the groove 12. The solution described in connection with FIGS. 1 and 8, however, of forming the coupling element as a single unitary molding, rather than in the form of two half sections, or multiple sections, is preferred; the elasticity of the material of the coupling element 25 is particularly well utilized when the coupling element is made as a unitary molding.

The crank and the coupling element can be used as a replacement part for cranks of current construction, that is, for cranks using a snap spring which engages in the groove 12 without requiring any changes on the vehicle. Thus, cranks of different color or appearance may be supplied, with their coupling elements; the coupling elements 25, 25', when preassembled with the crank, are less likely to become lost or to break than a spring clip passed through a slot formed in the hub of a crank.

Various changes and modifications are possible; for example, the hook which connects the crank 15 and the coupling element 25 could also be attached to the hub 17 and a suitable notch or window formed on the coupling element 25—effecting, for all practical purposes, merely a reversal of parts. More than one engagement hook 42, 43 may be used.

The same crank 15, of the same construction, can be used for various types of windows; to match a standard crank to different types of windows and window operating shafts, it is only necessary to provide different coupling elements, for example having different internal diameters of the portions 33, 35.

A close fit between the parts 40, 41 and 40', 41', respectively, and the recess 46 in hub 17 of crank 15 provides for guidance of the coupling element 25 both on the shaft as well as on the crank, and especially if tilting forces are applied to the crank, for example pressure or tension being applied to knob 16 attached to crank 15.

For some installations, particularly if the crank 15 should be capable of accepting relatively high tension forces in axial direction, a modified construction illustrated in FIGS. 9 to 15 is preferred. This construction is particularly suitable in vehicles in which it can be expected that the crank 15 will be used as a handle to close a vehicle door. Referring to FIG. 9, for example, this would mean, in effect, that an upwardly directed force is applied to knob 16. Applying such a force to the crank of FIG. 1 would result in substantial loading on the hook 42. The embodiment of FIGS. 9 to 15 illustrates a modification which is specifically designed to accept such axial upwardly directed forces, and particularly torques applied against the crank in an upward direction by pulling on knob 16—rather than in the direction intended for movement of the crank, that is, in rotary circumferential direction.

In the embodiment of FIGS. 9 to 15, elements similar to those previously described have been given the same reference numerals and will not be described again.

The embodiment of FIGS. 9 to 15 is particularly applicable for installations in which the crank 60 (FIG. 9) must be capable of accepting substantial tension forces in axial direction, or in twisting direction with respect to the shaft 10, for example if the crank 60 is also used to pull the door of the vehicle tight. The embodiment of FIGS. 9 to 15 is so constructed that it is particularly suitable to accept such axial forces.

The coupling element 61 (FIG. 9, FIG. 12) couples crank 60 to shaft 10. The shaft 10 is constructed as in the examples of FIGS. 1 to 8. The connection between the crank 60 and the coupling element 61 includes at least two hook-shaped elements to form locks locking the hub 62 of crank 60 to the coupling element 61. The hook-shaped elements engage, when assembled together, and are so arranged that they can be severed upon relative rotation of the coupling element 61 with respect to the hub 62 of crank 60. The engagement principle is in accordance with a bayonet or rotary catch connection; the hooks are not designed for elastic deflection (as in the embodiment of FIGS. 1 to 8) so that they can be subject to axial forces which are substantially greater than hook elements which may deflect. The turning torque between crank 60 and shaft 10 is provided, as before, by internal gear teeth or splines engaging in recesses or flutes of the shaft; the internal gearing 19 is formed in the hub 62 and engages the flutes 14 of the elongated outer portion 13 of shaft 12. The coupling element 61 is provided to prevent axial removal of the crank 60 from shaft 10.

The lower portion of the coupling element 61 is similar to the elements 25, 25' of the embodiment of FIGS. 1–8; it is a unitary injection molding of a polyamide plastic and is formed with a radial slit 26 to permit radial expansion. The lower portion 27 surrounds shaft 11 without play. When assembled, the rim 28 engages the underside of hub 62 of crank 60 and also fits against the inner wall panel of a car door, for example (not shown in FIG. 9). The interior portion is formed with a cylindrical section 33 and a conical portion 34 which defines the elastic engagement elements 35, similar to the construction of FIG. 3. Four break lines 64 subdivide the elements 35 into four segments—see FIG. 13—in order to increase its radial elasticity. The groove 38 (FIG. 14) is likewise provided to increase the capability of radial, resilient deflection.

Three connecting elements extend vertically from the rim 28. The elements at the right side of the center line—with respect to FIG. 13—have radially inwardly projecting portions 67. The section lines in FIGS. 9 and 12 are offset with respect to each other by 60° in order to be able to show the element 66. The element 68 of FIG. 13, at the left side of the center line thereof, has a radially outwardly facing projection 69. As best seen in FIGS. 10 and 13, a an bead 71 is formed at the upper side thereof which can engage in a matching groove 72 formed in hub 62 of crank 60 and thus prevents relative rotation between the hub 62, and hence crank 60 and the coupling element 61 due to vibration, shock, or the like. Similar edge beads are also provided on the connecting elements 65, 66 (not shown in the drawings for simplicity).

The three connecting elements 65, 66, 68 are offset with respect to each other by about—120°; each one of them is approximately 40° wide—although none of these angles are critical. In assembled condition, two of the elements are facing the side adjacent the operating button 16 of crank 60; one of them is located at the opposite side; they are capable of accepting axial tension applied on the operating button 16.

The hub 62, essentially, is shaped to be complementary to the elements 65, 66, 68. As seen in FIGS. 11 and 15, three openings 73, 74, 75 are formed therein through which the connecting elements 65, 66, 68 can be introduced by relative axial movement; subsequent relative rotation of the coupling element and the crank 60 locks the coupling element and the crank together by engaging the complementary projections in the hub 62. The two projections 76, 77 of the hub 62 as best seen in FIG. 12 fit the projections 69, 67 of the coupling element into the hub. As best seen in FIG. 9, the fit is a snug connection.

The handle 60, coupling element 61 and shaft 10 can be separately assembled; in a preferred form, the coupling element 61 is first connected with the hub 62 of the handle 60 to form a subassembly. The bayonet connection is locked, so that the beads 71 engage in the notch or groove 72 of the hub 62. The subassembly is then secured to the shaft 10, for example by axial pressure or a sharp blow, causing the catch elements 35 to snap in and engage the groove 12 in shaft 10.

Release of the crank 60 from shaft 10 is effected by relative rotation of the coupling element 61 with respect to the crank 60. The crank 60 is held in position and an awl, screwdriver, nail, or the like, is introduced through an opening 80 (FIG. 14) radially extending into the coupling element 61. The coupling element 61 is then rotated with respect to hub 62 by about 50° until the beads on the projections 65, 66, 68 are out of engagement with the grooves in the hub 62. The crank 60 can then be axially removed from the fluted portions 13 of the shaft; by spreading the coupling element apart, that is, upon engagement of a screwdriver, for example, in slot 26, the coupling element 61 can likewise be removed from the shaft. Upon renewed reattachment of the crank 60, a preferred assembly instruction would first pre-assemble the coupling element 61 to the hub 62 of crank 60 for subsequent conjoint assembly of the coupling element and of the crank to the shaft 12.

Various modifications may be made without departing from the scope of the inventive concept; for example, the relative rotation of the coupling element 61 and crank 60 can also be effect by forming the coupling element with externally accessible surfaces which, for example, can be engaged by pliers, wrenches, or the like, to provide for relative rotation between the coupling element 61 and crank 60. The rim 28 can be extended to project beyond the bottom outline of hub 62, for example.

Various other changes and modifications may be made, and features described in connection with any one of the embodiments may be used with any one of the others, within the scope of the inventive concept.

I claim:

1. Attachment arrangement to secure an operating handle (15, 60) to a shaft (10) to transmit torque, and rotary movement of the handle to the shaft while inhibiting undesired axial removal of the handle from the shaft while yet permitting controlled removal of the handle, comprising a coupling element (61) to couple the shaft (10) to the operating handle (60), the coupling element being made of a unitary molding of yielding plastic material formed with an opening therein matching and receiving the shaft therethrough;

interengaging projection and recess means (35) formed on the shaft (10) and on the coupling element (61), respectively, and forming an axial lock to prevent removal of the coupling element from the shaft in axial direction when the projection and recess means are engaged including;

a groove (12) formed in the shaft (10) and an elastic engagement portion (35) formed on said coupling element (61) and projecting inwardly of the opening and fitting into said groove (12) on the shaft (10) to reliably attach said coupling element to the shaft and prevent axial removal therefrom, the inwardly projecting portion (35) of the coupling element comprising an at least part circular bead which is radially subdivided into a plurality of inwardly projecting sections;

the operating handle (60) including a hub (62) surrounding the shaft and being formed with a recess to receive a portion of the coupling element (61); and releasable locking means (49; 65, 66, 67, 68, 69; 76, 77) formed on the portion of the coupling element and the hub of the operating handle and engaging the coupling element to the handle when in locked position to connect the handle to the shaft.

2. Arrangement according to claim 1, wherein said releasable locking means comprise (FIGS. 9 to 15) relatively circumferentially movable means (65, 66, 67, 68, 69; 76, 77) and include a bayonet-type releasable lock, relative rotation between said coupling element (61) and the handle (60) providing for respective engagement and disengagement of said bayonet-type lock.

3. Arrangement according to claim 1, wherein said unitary molding comprises a ring-like element formed with a radial slit (26), spreading of said radial slit permitting expansion of said element, said element, when the slit is not expanded, clamping around said shaft.

4. Arrangement according to claim 1, wherein a groove (38) is formed behind said bead radially outwardly therefrom to decrease the spring constant of the bead upon deflection thereof outwardly with respect to the center of the element.

5. Arrangement according to claim 4, wherein said groove (38) is in the form of a part-circular channel surrounding the bead.

6. Arrangement according to claim 1, wherein the inwardly projecting portion (35), in cross section, is barb-shaped.

7. Arrangement according to claim 6, wherein said inwardly projecting barb-shaped portion is angled inwardly with respect to the longitudinal axis of said coupling element by an angle of between about 15° to 40°.

8. Arrangement according to claim 7, wherein said angle is about 20°.

9. Arrangement according to claim 1, wherein said coupling element (61) comprises an axially extending projecting portion (27) extending in a direction away from the handle (60), said axially extending projecting portion extending around the shaft.

10. Arrangement according to claim 9, wherein said axially extending portion surrounds the shaft snugly to prevent penetration of contamination between the shaft and said coupling element.

11. Arrangement according to claim 1, wherein the operating shaft (10) includes an end portion (13) formed with axially extending grooves or flutes (17);

the handle (60) is formed with an opening having matching splines (19) fitting into the grooves or flutes (14) to transmit rotary forces and torque from the handle (60) to the shaft (10), the interengaging projection and recess means on the coupling element and the locking means between the coupling element (61) and the hub (62) of the handle conjointly transmitting axial forces between the handle and the shaft, whereas rotary torques are transmitted directly from the handle to the shaft.

12. Arrangement to claim 11, wherein the hub (62) of the handle (60) is made of plastic material, and the splines (19) are molded thereon.

13. Arrangement according to claim 1, wherein the releasable locking means formed on the hub (62) of the operating handle (60) are located adjacent the side of the handle facing the shaft (10).

14. Arrangement according to claim 1, wherein the hub (62) is formed with axial recesses;

and the coupling element (61) is formed with axial projections (40, 41, 65, 66, 68) fitting into the recesses of the hub to provide for axial guidance of the hub on the coupling element.

15. Arrangement according to claim 1, wherein (FIG. 8) the inwardly projecting portion has a pointed edge (35') engageable in the groove (12) of the shaft (10).

16. Arrangement according to claim 1, wherein (FIGS. 9–15) the releasable locking means comprises radially and axially projecting portions formed both on said coupling element (61) and the hub (62) of the handle (60), the radially extending portions being in overlapping relationship to form a bayonet-type connection to permit locking and unlocking by relative rotation of the handle and said coupling element.

17. Arrangement according to claim 16, wherein the axially extending portions (65, 66, 68) located on said coupling element (61) extend in axial direction towards the direction of the handle, said portions being formed with radially extending portions (67, 69).

18. Arrangement according to claim 17, wherein at least one of the radially extending portions (67) extends radially inwardly—with respect to the shaft (10)—of the coupling element.

19. Arrangement according to claim 17, wherein at least one of the radially extending portions extends radially outwardly—with respect to the shaft (10)—from the coupling element.

20. Arrangement according to claim 16, further comprising means (80) formed on said coupling element to rotate said coupling element relatively with respect to the operating handle (60).

21. Arrangement according to claim 20, wherein said relative rotation means comprises a surface discontinuity forming a tool engagement surface on said coupling element.

22. Arrangement according to claim 1, wherein the elastic engagement portion (35) is formed with an inwardly conical surface which is yieldingly deflectable outwardly upon engagement over the end portion of the shaft (10) and until the engagement portion (35) is seated in the groove (12) formed in the shaft.

23. Arrangement according to claim 22, wherein the operating shaft (10) includes an end portion (13) formed with axially extending grooves or flutes (17);

the handle (60) is formed with an opening having matching splines (19) fitting into the grooves or flutes (14) to transmit rotary forces and torque from the handle (60) to the shaft (10), the interengaging projection and recess means on the coupling element and the locking means between the coupling element (61) and the hub (62) of the handle conjointly transmitting axial forces between the handle and the shaft, whereas rotary torques are transmitted directly from the handle to the shaft.

24. Arrangement according to claim 23, wherein the hub (62) of the handle (60) is made of plastic material and the splines (19) are molded thereon to effect uninterruped engagement of the splines in the hub (62) of the handle (60) with the flutes (14) on the shaft (10) for transmission of torque and rotary movement of the handle.

25. An attachment subassembly to secure an operating handle (60) to a projecting stub shaft (10) to transmit torque and rotary movement of the handle to the shaft, and secure the handle to the shaft while inhibiting undesired axial removal of the handle from the shaft and while yet permitting controlled removal of the handle, comprising:

a hub (62) formed on the handle;

a separable coupling element (61) made of yielding plastic material formed with an opening therein to receive the stub shaft therethrough, said coupling element fitting into said hub of said handle;

releasable locking means (62) of the operating handle (60) and engaging, when in locked position, the coupling element and the hub, said locking means being accessible externally of the hub to permit release thereof and hence severance of the handle from the locking element and including radially and axially projecting portions (65, 66, 68, 72, 73, 74, 76, 77) formed both on said coupling element (61) and the hub (62) of the handle (60), the radially extending portions being in overlapping relationship to form a bayonet-type connection to permit locking and unlocking by relative rotation of the handle and said coupling element;

and resiliently yieldable interengaging means (35) formed on the coupling element (61) to engage with matching interengaging means (12) formed on the shaft (10), said interengaging means on the coupling element being resiliently yieldable and forming an axially interlocking connection between the coupling element and the stub shaft to prevent removal of the coupling element from the shaft in axial direction when said interengaging means are engaged, the yielding direction of said coupling element being radially outwardly with respect to said shaft to permit yielding engagement of said interengaging means and prevent removal of said coupling element, and hence of said operating handle unless said operating handle is first severed from the coupling element by unlocking of the releasable locking means.

26. Subassembly according to claim 25, wherein the coupling element comprises a ring-shaped element formed with a radially extending slit, the slit being essentially closed when assemblied into the hub of the handle, but permitting spreading of said coupling element after removal of the handle from the coupling element.

27. Subassembly according to claim 26, wherein the hub (62) of the handle (60) essentially surrounds the coupling element and prevents manual spreading of said slit when assembled into the hub.

28. Subassembly according to claim 27, wherein the stub shaft is formed with an at least partially circumferentially extending groove (12) and the interengaging means on the coupling element comprises inwardly directed barb-shaped resiliently outwardly deflectable, inwardly directed projections, deflectable outwardly upon assembly of the subassembly of the handle and the coupling element to the shaft and engageable with said groove and preventing axial removal after engagement in the groove, and hence preventing axial removal of the operating handle unless said releasable locking means are first released.

29. Subassembly according to claim 35, wherein the resiliently yieldable interengaging means (35) comprises an elastic engagement portion formed with an inwardly conical surface (34) which is yieldingly deflectable outwardly upon engagement over the end portion of the shaft and until the engagement portion (35) is seated in the groove (12) formed in the shaft.

30. Subassembly according to claim 27, wherein the operating shaft is formed with axially extending grooves or flutes (14) at the end portion (13) thereof;

and the handle (60) is formed with an opening having matching splines (19) fitting into the grooves or flutes (14) to transmit rotary forces and torque between the handle (60) and the shaft.

31. Subassembly according to claim 30, wherein the handle (60) is made of plastic materials and the splines (10) are molded thereon to effect an uninterruped engagement between the splines (19) in the opening of the handle (60) with the flutes (14) on the shaft.

32. Subassembly according to claim 25, wherein the axially extending portions (65, 66, 68) located on said coupling element (61) extend in axial direction towards the direction of the handle, said portions being formed with radially extending portions (67, 69).

33. Subassembly according to claim 32, wherein the axially extending portions (65, 66, 68) located on said coupling element (61) extend in axial direction towards the direction of the handle, said portions being formed with radially extending portions (67, 69).

34. Subassembly according to claim 32, wherein at least one of the radially extending portions extends radially outwardly—with respect to the shaft (10)—from the coupling element.

35. Subassembly according to claim 25, further comprising means (80) formed on said coupling element to rotate said coupling element relatively with respect to the operating handle (60).

36. Subassembly according to claim 35, wherein said relative rotation means comprises a surface discontinuity forming a tool engagement surface on said coupling element.

37. An attachment subassembly to secure an operating handle (60) to a projecting stub shaft (10) for transmitting torque between the handle and the shaft, and for securing the handle to the shaft while permitting controlled removal of the handle comprising axially extending splines and flutes (14) formed on an end portion of the shaft;

a hub (62) formed on the handle made of plastic material and comprising internal splines (19) formed in said plastic material complementary to the splines on the stub shaft for interengagement therewith;

and a severable coupling element (61) fitting into the hub of said handle and formed with an opening therethrough to receive the stub shaft therein, made of yielding plastic material, said coupling element being formed with spreading means (34) for spreading the coupling element upon insertion of the stub shaft therethrough comprising an essentially conical surface (34) within the opening of the coupling element to permit spreading the coupling element upon engagement of the shaft through the opening of the coupling element.

38. Subassembly according to claim 37, further including releasable locking means comprising radially and axially projecting portions (65, 66, 68, 72, 73, 74, 76, 77) formed both on said coupling element (61) and the hub (62) of the handle (60), the radially extending portions being in overlapping relationship to form a bayonet-type connection to permit locking and unlocking by relative rotation of the handle and said coupling element.

39. Subassembly according to claim 38, wherein the axially extending portions (65, 66, 68) located on said coupling element (61) extend in axial direction towards the direction of the handle, said portions being formed with readialy extending portions (67, 69).

40. An attachment subassembly to secure an operating handle (60) to a projecting stub shaft (10) for transmitting torque between the handle and the shaft, and for securing the handle to the shaft while permitting controlled removal of the handle comprising axially extending splines and flutes (14) formed on an end portion of the shaft;

a hub (62) formed on the handle made of plastic material and comprising internal splines (19) formed in said plastic material complementary to the splines on the hub shaft for interengagement therewith;

a severable coupling element (61) fitting into the hub of said handle and formed with an opening therethrough to receive the stub shaft therein, made of yielding plastic material, said coupling element being formed with spreading means (34) for spreading the coupling element upon insertion of the stub shaft therethrough comprising an essentially conical surface (34) within the opening of the coupling element to permit spreading the coupling element upon engagement of the shaft through the opening of the coupling element; and interengaging projection-and-recess means (12, 35) formed on the shaft (10) and the coupling element (61) respectively, including a groove (12) formed in the shaft (10) and an elastic engagement portion (35) formed on said coupling element (61) and projecting inwardly of the opening therein and fitting into said groove, the inwardly projecting portion (35) comprising an at least part circular bead which is radially subdivided into a plurality of inwardly projecting sections.

41. Subassembly according to claim 40, wherein the inwardly projecting portion (35), in cross-section, is barb-shaped.

42. Subassembly according to claim 41, wherein said severable coupling element is a unitary molding comprising a ring-like element formed with a radial slit (26), spreading of said radial slit permitting expansion of said element, said element, when the slit is not expanded, clamping around said shaft (10).

43. Attachment arrangement to secure an operating handle (15, 60) to a shaft (10) to transmit movement of the handle to the shaft while inhibiting undesired axial removal of the handle from the shaft while yet permitting controlled removal of the handle, comprising a coupling element (25, 61) to couple the shaft (10) to the operating handle (15, 60), the coupling element being made of yielding plastic material formed with an opening therein to receive the shaft therethrough;

interengaging projection and recess means (12, 35) formed on the shaft and on the coupling element, respectively, and forming an axial lock to prevent removal of the coupling element from the shaft in axial direction when the projection and recess means are engaged;

the operating handle (15, 60) including a hub (17, 62) surrounding the shaft and being formed with a recess to receive a portion of the coupling element (25, 61);

releasable locking means (42, 49; 65, 66, 67, 68, 69; 76, 77) formed on the portion of the coupling element and the hub (17, 62) of the operating handle and engaging the coupling element to the handle when in locked position to connect the handle to the shaft, said locking means being accessible externally of the hub to permit release thereof and hence axial removal of the handle from the shaft;

and wherein the hub (17, 62) is formed with axial recesses (46, 73, 74, 75);

and the coupling element (25, 25', 61) is formed with axial projections (40, 41, 65, 66, 68) fitting into the recesses of the hub to provide for axial guidance of the hub on the coupling element.

44. Arrangement according to claim 43, wherein the axial recesses are extended to form radially extending portions;

and the axial projections on the coupling element include radially projecting portions in overlapping relationship with respect to the radially extending recesses for form a bayonet-type connection and permit locking and unlocking the handle and said coupling element by relative rotation.

45. Attachment arrangement according to claim 43 further including engaging spreading surfaces formed on the shaft and on the coupling element, respectively, for spreading the coupling element upon insertion of the shaft therethrough.

* * * * *